US011060427B2

(12) United States Patent
Berndt

(10) Patent No.: US 11,060,427 B2
(45) Date of Patent: Jul. 13, 2021

(54) VALVE TRAIN INCLUDING ENGINE BRAKING SYSTEM

(71) Applicant: Schaeffler Technologies AG & Co. KG, Herzogenaurach (DE)

(72) Inventor: Eric Berndt, Whitefish Bay, WI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 74 days.

(21) Appl. No.: 16/449,642

(22) Filed: Jun. 24, 2019

(65) Prior Publication Data

US 2020/0400047 A1 Dec. 24, 2020

(51) Int. Cl.
*F01L 1/24* (2006.01)
*F01L 13/06* (2006.01)

(52) U.S. Cl.
CPC ..... *F01L 13/06* (2013.01); *F01L 1/2411* (2013.01)

(58) Field of Classification Search
None
See application file for complete search history.

(56) References Cited

U.S. PATENT DOCUMENTS 4,054,109 A * 10/1977 Herrin ..... F01L 1/245 123/90.16
4,384,558 A 5/1983 Johnson
4,475,500 A 10/1984 Bostelman
4,881,499 A 11/1989 Dietrich et al.
6,293,248 B1 9/2001 Zsoldos et al.
7,296,549 B1 * 11/2007 Sailer ..... F01L 1/14 123/90.45
7,434,557 B2 * 10/2008 Sailer ..... F01L 1/24 123/90.48
9,115,654 B2 8/2015 Schnell
10,072,535 B2 * 9/2018 Stallmann ..... F01L 1/465
10,260,386 B2 * 4/2019 Andrisani ..... F01L 13/06
10,794,235 B1 * 10/2020 Erickson ..... F01L 1/182
2001/0023671 A1 * 9/2001 Vorih ..... F01L 9/02 123/90.12
2002/0035978 A1 3/2002 Usko
2003/0010305 A1 1/2003 Genise
2005/0229887 A1 10/2005 Sailer et al.
(Continued)

FOREIGN PATENT DOCUMENTS

DE 102010008928 A1 8/2011
DE 102010011455 A1 9/2011
(Continued)

*Primary Examiner* — Patrick Hamo
*Assistant Examiner* — Wesley G Harris
(74) *Attorney, Agent, or Firm* — Volpe Koenig

(57) ABSTRACT

A valve train arrangement including at least one exhaust valve and a reverse-spring hydraulic lash adjuster (RSHLA) is provided. The RSHLA has a predetermined closing velocity. An engine brake system is configured to engage the exhaust valve, such that: (i) upon activation of the engine brake system, the engine brake system engages the at least one exhaust valve to open the at least one exhaust valve; and (ii) upon deactivation of the engine brake system, the engine brake system disengages the at least one exhaust valve such that the at least one exhaust valve is closed. A deactivation velocity of the engine brake system is less than the predetermined closing velocity of the RSHLA.

15 Claims, 9 Drawing Sheets

(56) References Cited

U.S. PATENT DOCUMENTS

| | | | | |
|---|---|---|---|---|
| 2008/0022955 | A1* | 1/2008 | Sailer | F01L 1/24 123/90.46 |
| 2008/0072857 | A1* | 3/2008 | Sailer | F01L 1/2405 123/90.55 |
| 2008/0087244 | A1* | 4/2008 | Sailer | F01L 13/0031 123/90.52 |
| 2009/0083959 | A1* | 4/2009 | Sailer | F01L 1/245 29/213.1 |
| 2011/0094467 | A1* | 4/2011 | MacVicar | F01L 1/2411 123/90.53 |
| 2011/0220052 | A1 | 9/2011 | Sailer et al. | |
| 2011/0220062 | A1 | 9/2011 | Sailer et al. | |
| 2015/0122220 | A1 | 5/2015 | Cecur | |
| 2015/0354418 | A1* | 12/2015 | Jo | F01L 1/267 123/323 |
| 2016/0146074 | A1 | 5/2016 | Lynch | |
| 2018/0195420 | A1* | 7/2018 | Stallmann | F01L 1/465 |

FOREIGN PATENT DOCUMENTS

| | | | |
|---|---|---|---|
| DE | 102013215622 | A1 | 2/2015 |
| JP | 08284620 | A | 10/1996 |
| WO | 2008116710 | A1 | 10/2008 |

* cited by examiner

VALVE TRAIN INCLUDING ENGINE BRAKING SYSTEM

FIELD OF INVENTION

The present invention relates to a valve train arrangement, and is more particularly related to an engine braking system in a valve train arrangement.

BACKGROUND

Existing engine compression braking systems typically require applying a direct force to a valve or valve bridge, which creates lash. For hydraulic valve trains, a hydraulic lash adjuster (HLA) can be provided to compensate for this lash. However, known HLAs in valve train arrangements including engine braking systems, cause the exhaust valve to remain open after an engine braking event. Essentially, the HLA will expand to accommodate lash that the HLA perceives in the valve train arrangement caused by the engine exhaust valve opening, but then be unable to compress as the exhaust valve closes after the engine braking event.

There are a variety of types of HLAs, including conventional HLAs and reverse spring HLAs (RSHLA). A conventional HLA typically includes a valve assembly including a closing body that is biased closed. If a compressive force is applied to a conventional HLA, the valve assembly remains closed and the conventional HLA will be stiff, e.g. hydraulic fluid is held in the high pressure chamber and the HLA acts as a vertical column. In this mode, the conventional HLA will only compress as fast as oil is able to pass through a leakage gap.

In a RSHLA, a checkball spring or valve spring is provided that biases a checkball or closing body away from a valve seat such that the valve assembly is open in the free state. To close the valve assembly, the plunger or piston must move fast enough relative to the outer housing such that hydraulic fluid in the pressure chamber forces the closing body against the valve seat and overcomes the force of the valve spring. This relative speed is typically referred to as the critical velocity, closing velocity, or predetermined closing velocity.

When these known HLAs or RSHLAs are used in a valve train arrangement with an engine braking system, they can cause the exhaust valve to remain open after the engine braking event, causing damage to the engine or rendering the engine inoperable.

It would be desirable to provide a valve train arrangement including an engine braking assembly that also includes a HLA.

SUMMARY

A valve train arrangement including at least one exhaust valve and a reverse-spring hydraulic lash adjuster (RSHLA) is provided. The RSHLA has a predetermined closing velocity, which is described in more detail herein. An engine brake system is configured to engage the exhaust valve, such that: (i) upon activation of the engine brake system, the engine brake system engages the at least one exhaust valve to open the at least one exhaust valve; and (ii) upon deactivation of the engine brake system, the engine brake system disengages the at least one exhaust valve such that the at least one exhaust valve is closed. A deactivation velocity of the engine brake system is lower than the predetermined closing velocity of the RSHLA.

In another embodiment, a method of accommodating lash in a valve train including an engine braking system is disclosed. The method includes arranging a reverse-spring hydraulic lash adjuster (RSHLA) between (i) a support engaging a lobe defined on a camshaft, and (ii) at least one exhaust valve; activating an engine brake system to drive the at least one exhaust valve to an open position, wherein the RSHLA expands to maintain contact with the support and the at least one exhaust valve; and deactivating the engine brake system such that engine brake system disengages from the at least one exhaust valve, and the RSHLA compresses as the at least one exhaust valve returns to a closed position while the RSHLA maintains contact with the support and the at least one exhaust valve.

In one embodiment, the RSHLA includes: an outer housing defining at least one hydraulic fluid passage; a plunger slidingly arranged within the outer housing; a return spring arranged between the outer housing and the plunger; and a valve assembly. The valve assembly includes: a closing body configured to block an opening defining a connection between an upper chamber and lower chamber of the RSHLA, a retainer arranged between the plunger and the outer housing to hold the closing body, and a valve spring positioned between the opening and the closing body. The valve spring biases the closing body to an open position. In one embodiment, the valve assembly is open and the closing body remains unseated from the opening during deactivation of the engine brake system.

The predetermined closing velocity of the RSHLA is determined based on a speed of a relative displacement between the plunger and the outer housing, and the closing body becomes seated to the opening during the relative displacement.

The predetermined closing velocity of the RSHLA is based on at least one of: viscosity of hydraulic fluid in the RSHLA; flow rate of hydraulic fluid in the RSHLA; clearance between the plunger and the outer housing; flow rate through orifices defined in the retainer; a relative distance between the retainer, the closing body, and the opening; a profile of an interface defined between the closing body and the opening; stiffness of the return spring; or stiffness of the valve spring.

The RSHLA is in an extended position after activation of the engine brake system. The RSHLA moves from the extended position to a compressed position upon the engine brake system transitioning from activation to deactivation.

In one embodiment, the support is a lifter. In another embodiment, the support is a rocker arm.

Additional embodiments are disclosed herein.

BRIEF DESCRIPTION OF THE DRAWINGS

The foregoing Summary and the following Detailed Description will be better understood when read in conjunction with the appended drawings, which illustrate a preferred embodiment of the invention. In the drawings.

DETAILED DESCRIPTION OF THE PREFERRED EMBODIMENTS

Figure 1:
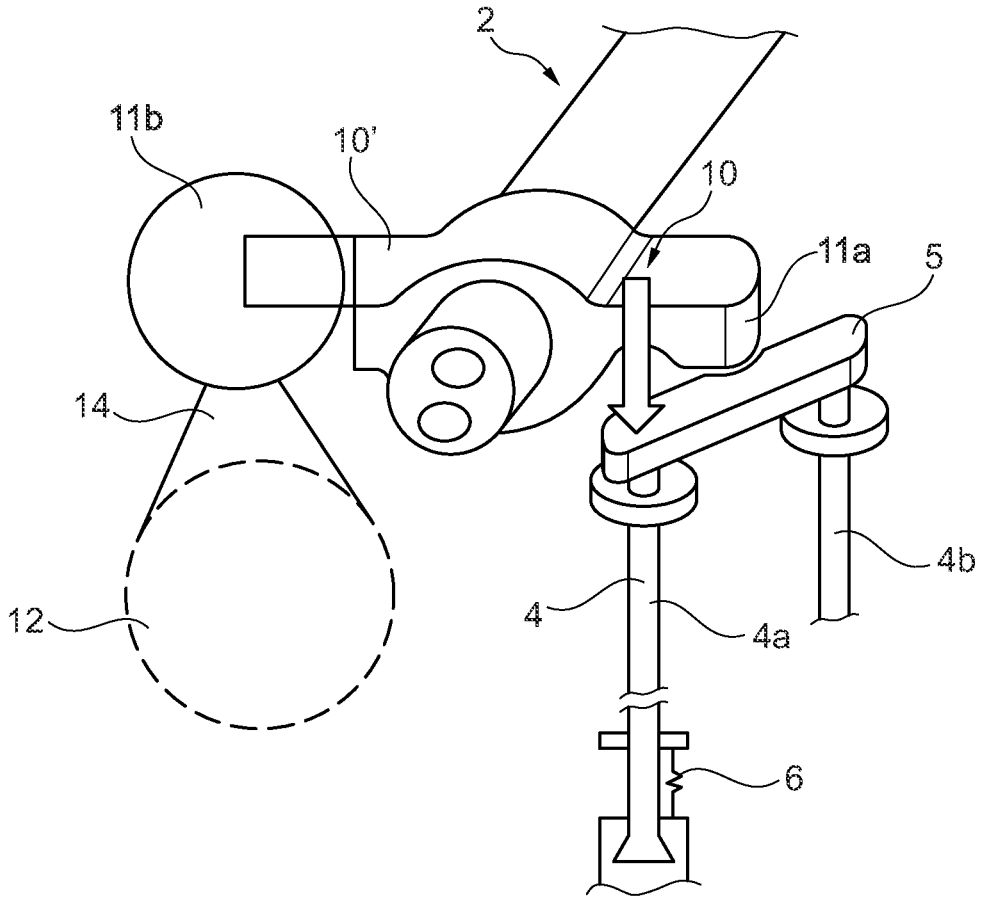
FIG. 1 is a view of a valve train arrangement according to one embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

A valve train arrangement 2 is generally disclosed and shown in FIG. 1. The arrangement 2 includes at least one exhaust valve 4, including a stem 4*a* that is configured to be opened and closed which is configured to open and close. A support 10 is arranged adjacent to the at least one exhaust valve 4 and is configured to engage a lobe 14 defined on a camshaft 12. The term support 10 is used generally herein to refer to a rocker arm 10' or a lifter 10". The support 10 defines a cavity 11*a*, which is adapted to hold a hydraulic lash adjuster described in more detail herein. The support 10 can include a hydraulic fluid circuit adapted to provide pressurized hydraulic fluid to the cavity 11*a*.

Figure 3A:
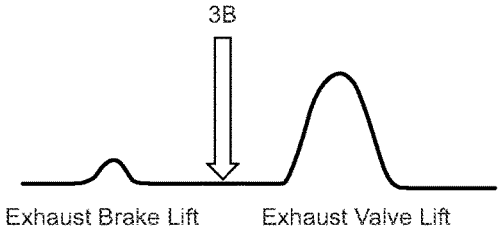
FIG. 3A illustrates a base circle mode lifting profile.
Figure 3B:
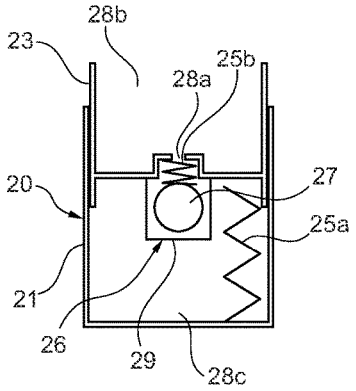
FIG. 3B illustrates a schematic view of the RSHLA at a particular position along the life profile of FIG. 3A.
Figure 3C:
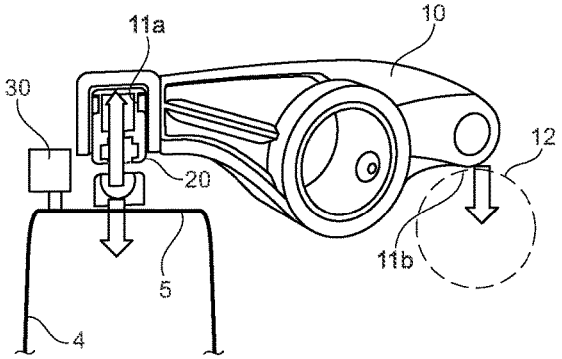
FIG. 3C is a view of the valve train arrangement during the base circle mode.

As shown in FIG. 3C, a reverse-spring hydraulic lash adjuster (RSHLA) 20 is positioned within the cavity 11*a* of the support 10. The RSHLA 20 is configured to adjust lash between the support 10, camshaft 12, and the at least one exhaust valve 4. The RSHLA 20 has a predetermined closing velocity, which is described in more detail herein. Hydraulic lash adjusters, including reverse spring variations, are well known and are generally described in U.S. Publications 2009/0083959 and 2005/0229887, which are incorporated by reference as if fully set forth herein.

Figure 2A:
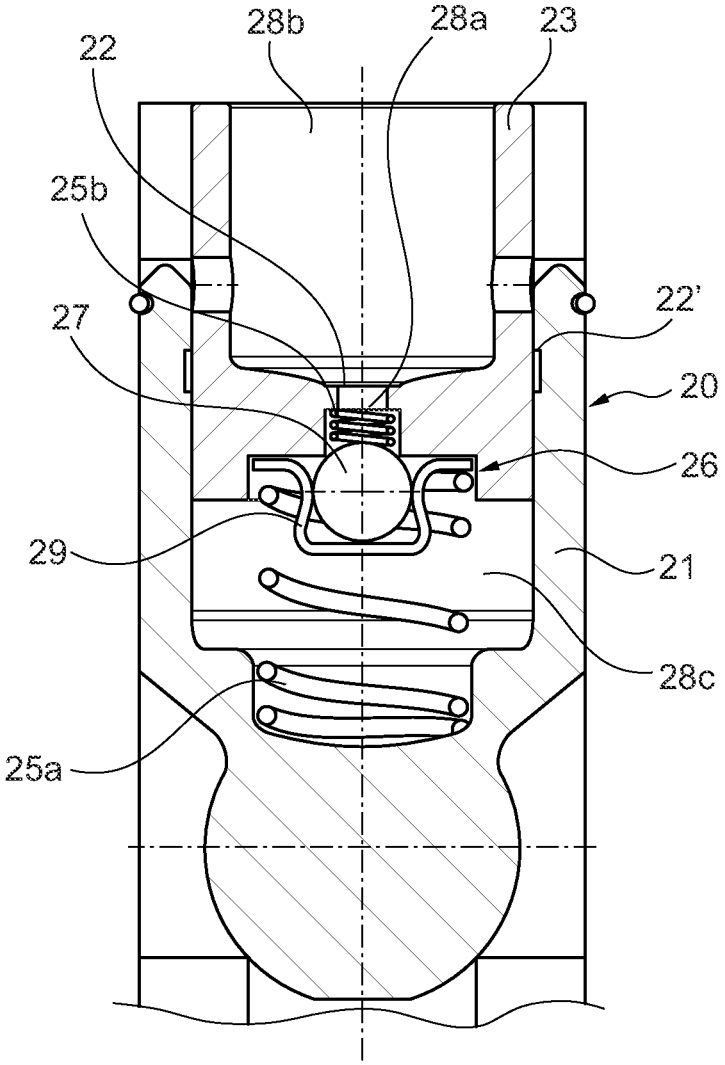
FIG. 2A is a magnified side cross-sectional view of a RSHLA for the valve train arrangement of FIG. 1.
Figure 2B:
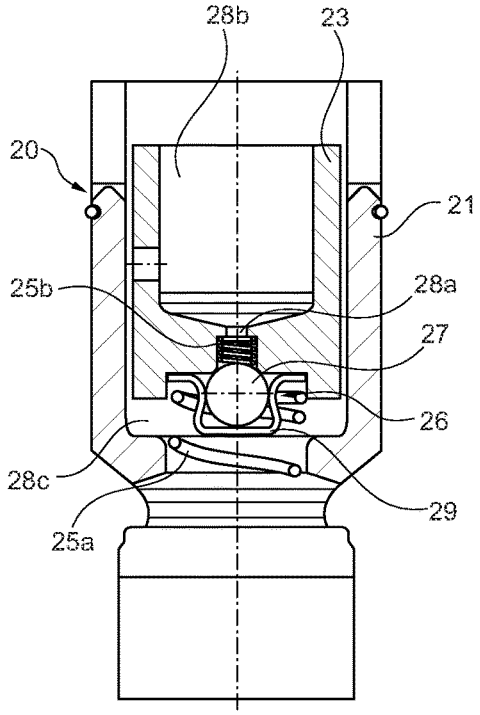
FIGS. 2B and 2C illustrate alternative states for the RSHLA of FIG. 2A.
Figure 2C:
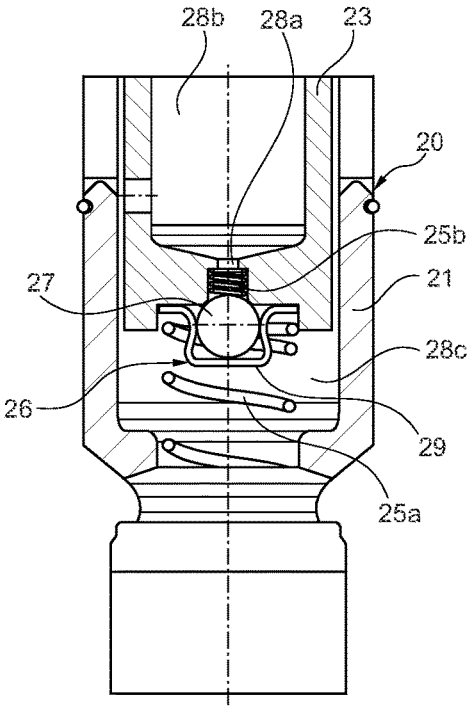

In the embodiment shown in FIGS. 2A-2C, the RSHLA 20 includes an outer housing 21 defining at least one hydraulic fluid passage 22, a leakage gap 22', a plunger 23 slidingly arranged within the outer housing 21, a return spring 25*a* arranged between the outer housing 21 and the plunger 23, and a valve assembly 26. The valve assembly 26 includes a closing body 27 configured to block an opening 28*a* defining a connection between an upper chamber 28*b* and lower chamber 28*c* of the RSHLA 20, and a retainer 29 arranged in the plunger 23 to hold the closing body 27, and a valve spring 25*b* positioned between the opening 28*a* and the closing body 27. The valve spring 25*b* biases the closing body 27 to an open position.

One of ordinary skill in the art would understand that the RSHLA 20 would include leakage gaps or bleed holes to allow for a flow of hydraulic fluid.

An engine brake system 30 is configured to engage the exhaust valve 4. The engine brake system 30 is schematically illustrated in the drawings. In one embodiment, the engine brake system 30 can include a lobed shaft. In another embodiment, the engine brake system 30 can include an actuator, such as a linear actuator or solenoid. One of ordinary skill in the art would understand from the present disclosure that the exact configuration of the engine brake system 30 can be varied. Once the engine brake system 30 is actuated, then the engine brake system 30 engages the exhaust valve 4 to open the exhaust valve 4. This process is known as engine braking, which is described in more detail in U.S. Publications 2011/0220062 and 2016/0146074 (which are incorporated by reference as set forth herein).

The engine brake system 30 can engage directly against a stem for the exhaust valve 4 or engage a bridge 5 connected to the exhaust valve 4. Upon deactivation of the engine brake system 30, then the engine brake system 30 disengages the exhaust valve 4. The exhaust valve 4 (or its stem) is biased closed by a valve closing spring 6, shown schematically in FIG. 1.

A deactivation velocity of the engine brake system 30 is slower than the predetermined closing velocity of the RSHLA 20. Considering variability of the predetermined closing velocity of the RSHLA and considering effects such as tolerances, temperatures, etc., the deactivation velocity of the engine brake system 30 will generally not exceed 80% of the predetermined closing velocity of the RSHLA 20.

The deactivation velocity of the engine brake system 30 is determined based on a distance that the engine brake system 30 drives the exhaust valve 4, which is based on a length of the stroke of the engine brake system 30. A period of the deactivation velocity is determined by the length of time that elapses between a highest point of engagement between the engine brake system 30 and the exhaust valve 4 until the engine brake system 30 ceases its closing displacement of the exhaust valve 4.

The predetermined closing velocity of the RSHLA 20 is based on at least one of: viscosity of hydraulic fluid in the RSHLA 20; flow rate of hydraulic fluid in the RSHLA 20; clearance or a leakage gap 22' between the plunger 23 and the outer housing 21; flow rate through orifices defined in the retainer 29; a relative distance between the retainer 29, the closing body 27, and the opening 28*a*; a profile of an interface defined between the closing body 27 and the opening 28*a*; stiffness of the return spring 25*a*; or stiffness of the valve spring 25*b*. Any one or more of these variables can affect the predetermined closing velocity of the RSHLA 20.

One of ordinary skill in the art would understand that the predetermined closing velocity for a particular class or line of RSHLA 20 will generally be known based on standardized operating conditions.

The predetermined closing velocity will vary dramatically depending on conditions of the hydraulic fluid and temperature. In one embodiment, the predetermined closing velocity can vary from (X) mm/second to 20(X) mm/second. For a relatively lower temperature, the predetermined closing velocity can be (X) mm/second, and for a relatively higher temperature, the predetermined closing velocity can be 20(X) mm/second.

Due to the variations in operating conditions, the general strategy is to minimize the predetermined closing velocity since this minimizes lift loss for a normal valve event. However, the predetermined closing velocity must also be higher than the valve brake event closing time which must be fast enough to meet the engine combustion requirements.

The predetermined closing velocity of the RSHLA 20 is determined based on the speed of relative displacement between the plunger 23 and the outer housing 21, during which the closing body 27 becomes engaged with or seated to the opening 28*a* during this relative displacement.

FIGS. 3A-7D illustrate varying positions of the RSHLA 20 according to different lift events, i.e. an exhaust valve lift event and an exhaust brake lift event.

FIGS. 3A-3C illustrate a base circle mode for the valve train arrangement 2. As shown in FIG. 3B, the valve assembly 26 is open such that the closing body 27 is unseated and the opening 28*a* is unobstructed. In this condition, the RSHLA 20 expands to take up any clearance between the cam lobe 14 defined on the camshaft 12 and the exhaust valve 4, and/or bridge 5. A base of the RSHLA is grounded to the exhaust valve 4 or bridge 5 in this condition. In the base circle mode in FIG. 3B, the upper chamber 28*b* is in a relatively low pressure state and the lower chamber 28*c* is in a relatively low pressure state.

Arrows are provided on FIGS. 3C, 4D, 5D, 6D, and 7D to generally indicate forces between the exhaust valve 4 or bridge 5, the support 10, the RSHLA 20, and the engine brake system 30.

Figure 4A:
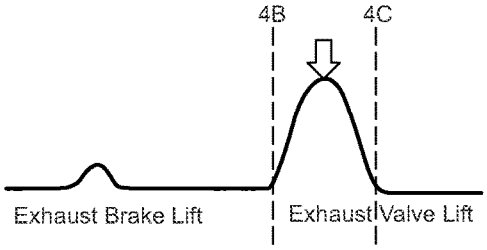
FIG. 4A illustrates a lifting profile during an exhaust valve lift event (i.e. valve opening mode).
Figure 4B:
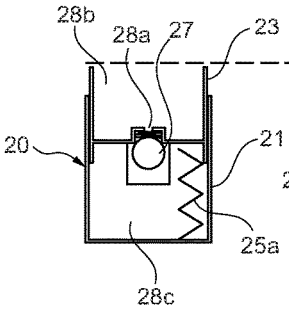
FIG. 4B illustrates a schematic view of the RSHLA during the beginning of a lift event.
Figure 4C:
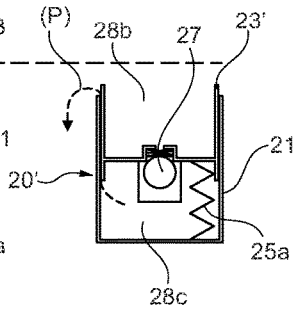
FIG. 4C illustrates a schematic view of the RSHLA at the end of a lift event.
Figure 4D:
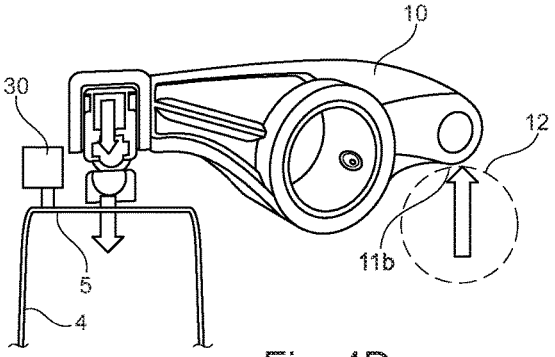
FIG. 4D is a view of the valve train arrangement during a valve opening mode.

FIGS. 4A-4D illustrate a valve opening mode for the valve train arrangement 2. In this mode, an exhaust valve cam lobe 14 defined on the camshaft 12 pushes against a cam follower lib on the support 10. As shown in FIG. 4B, the RSHLA 20 is shown at the beginning of the lift event during which the valve assembly 26 is closed, assuming the velocity of the exhaust valve opening event is greater than the RSHLA critical velocity, and the return spring 25*a* is expanded. In FIG. 4C, which corresponds to an end of the lift event, the RSHLA 20 is compressed based on the resulting force of the support 10 pivoting due to engagement with the exhaust valve lobe 14 formed on the camshaft 12 causing the RSHLA 20 to leak down as described below. In FIGS. 4B and 4C, the upper chamber 28*b* is in a relatively lower pressure state and the lower chamber 28*c* is in a relatively higher pressure state. In FIG. 4C, hydraulic fluid bleeds out (fluid pressure (P)) through a leakage gap 22' provided between the plunger 23 and the housing 21. During this stage, the valve assembly 26 remains closed and the return spring 25*a* and plunger 23 are compressed. High pressure hydraulic fluid is trapped in the lower chamber 28*c*, thereby transferring force from the exhaust valve cam lobe 14 on the camshaft 12 to the exhaust valve 4 and/or bridge 5.

Figure 5A:
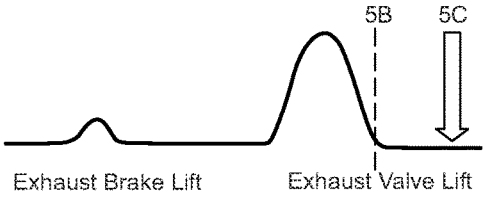
FIG. 5A is a lift profile illustrating a return to a base circle mode.
Figure 5B:
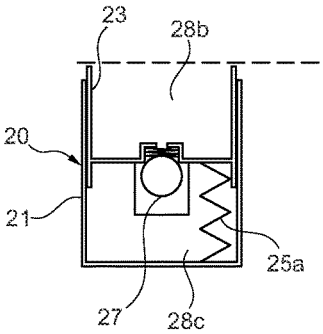
FIG. 5B illustrates a schematic view of the RSHLA during the end of a lift event.
Figure 5C:
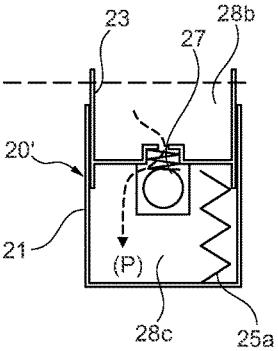
FIG. 5C illustrates a schematic view of the RSHLA during a return to the base circle.
Figure 5D:
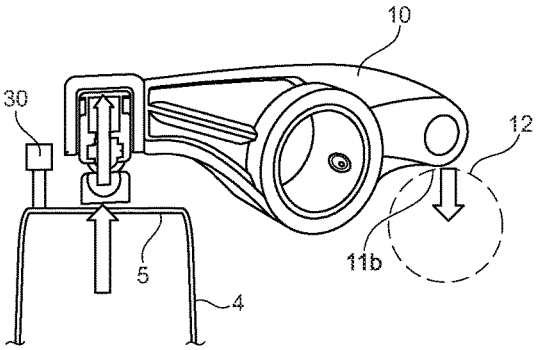
FIG. 5D is a view of the valve train arrangement during a return to the base circle.

FIGS. 5A-5D illustrate a return to the base circle mode for the valve train arrangement 2. The cam follower 11*b* is grounded to the camshaft 12, and an exhaust valve closing spring 6 (optionally through bridge 5) forces the exhaust valve 4 closed until the exhaust valve is seated again. During this phase, the RSHLA 20 (through the return spring 25*a*) expands to take up the resulting clearance between the exhaust valve cam lobe 14 defined on the camshaft 12 and the exhaust valve 4 and/or bridge 5. In FIG. 5B, which corresponds to the end of the lift event, the valve assembly 26 is closed and the return spring 25*a* and the plunger 23 remain compressed. In this state, the upper chamber 28*b* is under relatively lower pressure and the lower chamber 28*c* is under relatively higher pressure. In FIG. 5C, which corresponds to a return to the base circle mode, the valve assembly 26 opens and the return spring 25*a* biases the plunger 23 upward to accommodate lash. In this state, the upper chamber 28*b* is still under lower pressure and the lower chamber 28*c* is under lower pressure. As shown in FIG. 5C, hydraulic fluid flows (P) from the upper chamber 28*b* to the lower chamber 28*c*.

Figure 6A:
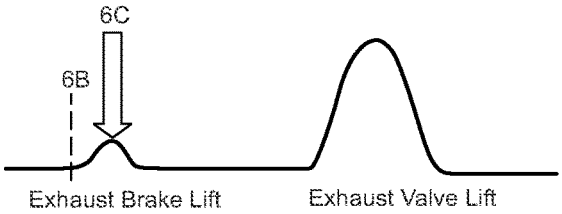
FIG. 6A illustrates a peak of an exhaust brake mode of a lift profile.
Figure 6B:
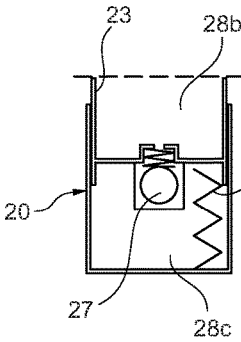
FIG. 6B illustrates a schematic view of the RSHLA during the base circle
Figure 6C:
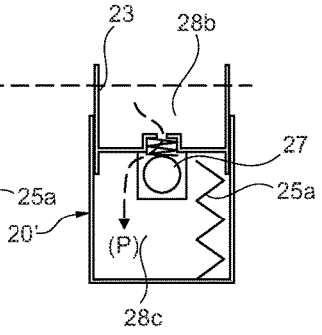
FIG. 6C illustrates a schematic view of the RSHLA during a peak of the exhaust brake event.
Figure 6D:
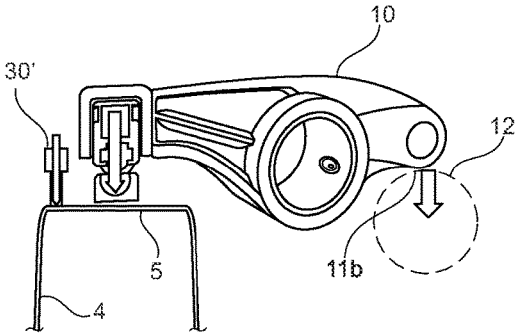
FIG. 6D is a view of the valve train arrangement during a peak of the exhaust brake mode.

FIGS. 6A-6D illustrate a peak of an exhaust brake mode for the valve train arrangement 2. In this mode, the engine brake system 30 is actuated (indicated by 30' in FIG. 6D) and pushes on the exhaust valve 4 (optionally through bridge 5) to open the exhaust valve 4 and provide an engine braking mode. As the engine brake system 30 presses downward on the exhaust valve 4 (optionally through bridge 5), lash is created between the support 10 and the exhaust valve 4 and/or bridge 5. Accordingly, the RSHLA 20 expands to compensate for this newly created lash. FIG. 6B is a schematic view corresponding to a base circle mode before the exhaust brake event. FIG. 6C illustrates a peak of the exhaust brake event, the valve assembly 26 is open and the plunger 23 expands due to the return spring 25*a*. The upper chamber 28*b* and the lower chamber 28*c* are under relatively lower pressure in both FIGS. 6B and 6C. As shown in FIG. 6C, hydraulic fluid flows (P) from the upper chamber 28*b* to the lower chamber 28*c*. In FIG. 6C, the RSHLA 20' is in an extended position at the peak of activation of the engine brake system.

Figure 7A:
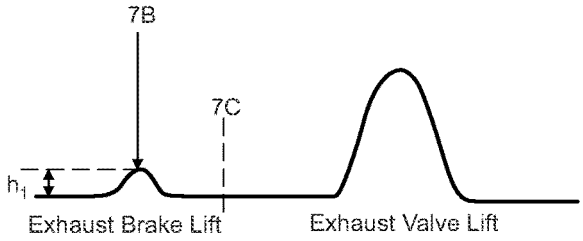
FIG. 7A illustrates a lifting profile immediately after the exhaust brake lift event.
Figure 7B:
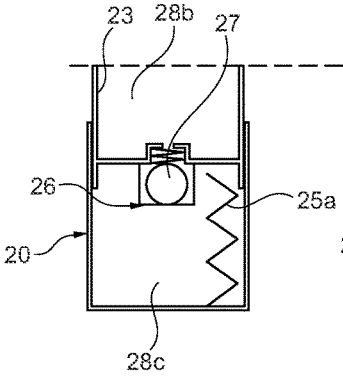
FIG. 7B illustrates a schematic view of the RSHLA during a peak of the exhaust brake event.
Figure 7C:
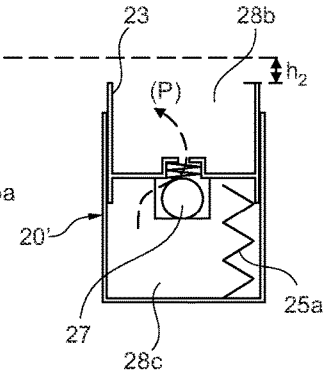
FIG. 7C illustrates a schematic view of the RSHLA during a return to the base circle.
Figure 7D:
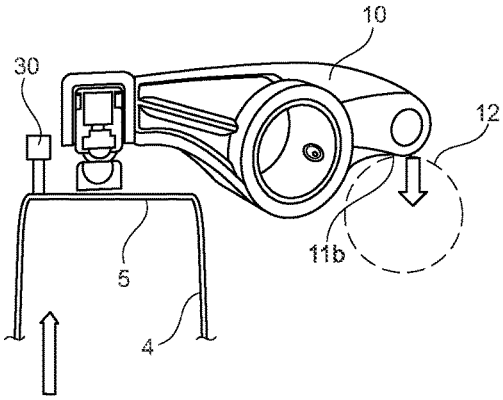
FIG. 7D is a view of the valve train arrangement after returning to the base circle following an exhaust brake lift event.

FIGS. 7A-7D illustrate a return to the base circle immediately after an engine braking event. FIG. 7B illustrates a peak of the exhaust valve brake event. During this stage, the valve assembly 26 is open and the RSHLA 20 is expanded to take up lash in the system. In FIG. 7C, a return to the base circle event is illustrated during which the valve assembly 26 is open and the RSHLA 20' is compressed so the exhaust valve 4 can close following the engine brake event. As the engine brake system 30 is deactivated, the valve closing spring 6 pushes the RSHLA 20 back to a compressed or base circle state. In both FIGS. 7B and 7C, both the upper chamber 28*b* and the lower chamber 28*c* are under relatively lower pressure. As shown in FIG. 7C, hydraulic fluid flows (P) from the lower chamber 28*c* to the upper chamber 28*b* in the RSHLA 20'. In FIG. 7B, the valve assembly 26 is open and the closing body 27 remains unseated from the opening 28*a* during deactivation of the engine brake system 30. As the system transitions from the maximum of the exhaust brake lift event to the base circle mode, the RSHLA 20 transitions in FIG. 7B from an extended position immediately following the braking event to the compressed position in FIG. 7C.

FIG. 7A illustrates a first height ($h_1$) of the exhaust brake lift event and close event. This first height ($h_1$) is the length of the stroke of the engine braking system 30. As shown in FIG. 7C, the plunger 23 is displaced a second height ($h_2$) which is proportional to the first height ($h_1$) of the exhaust brake lift event based on the geometrical relationship between the camshaft 12, fulcrum location of the support 10, and the contact point of the RSHLA 20 to the valve 4 and/or bridge 5. The speed at which an actuator (such as a lobe, solenoid or other actuating component) of the engine braking system 30 moves the first height ($h_1$) during the exhaust brake closing event, and the speed at which the plunger 23 moves a distance of the second height ($h_2$) is controlled such that the RSHLA 20 does not lock up due to the closing body 27 becoming seated against the opening 28*a*.

In order to ensure that the RSHLA 20 is compressible following the engine braking event, the engine braking system 30 is modified to have a specific deactivation velocity that is slower or less than the predetermined closing velocity of the RSHLA 20. Or, conversely, the RSHLA 20 can be designed such that the predetermined closing velocity is greater than the engine braking system 30 deactivation velocity. However, consideration must also be given to relationship between the predetermined closing velocity of the RSHLA 20 relative to the normal exhaust valve lift event (reference FIG. 4A). The predetermined closing velocity of the RSHLA 20 needs to be less than the valve opening velocity for the normal exhaust valve lift event. Therefore, it is necessary to design the entire valve train system to ensure a suitable relationship between these competing requirements.

Figure 8:
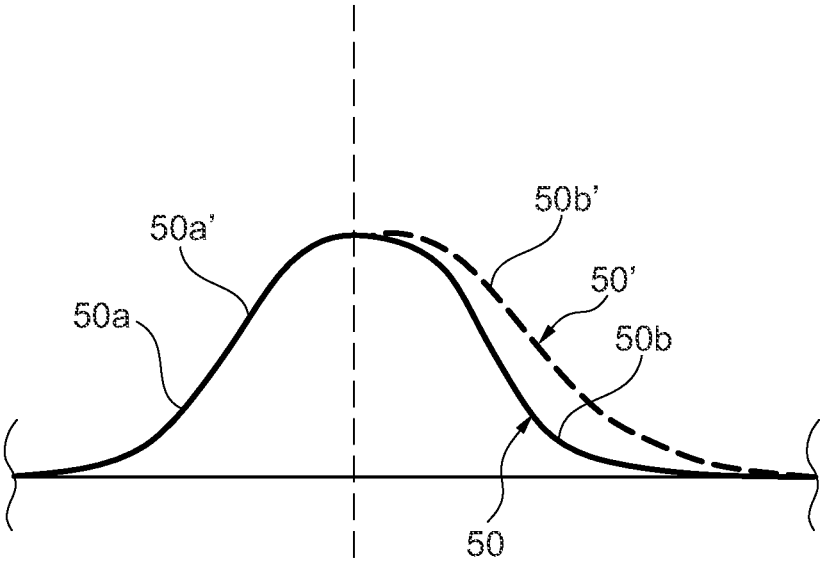
FIG. 8 illustrates two lift profiles for an exhaust brake system.

FIG. 8 illustrates two exemplary lift profiles 50, 50' for an engine brake system 30. The profile 50 illustrates a profile which includes an activation flank 50*a* and deactivation flank 50*b*. The profile of the activation flank 50*a* is not critical to the function of the RSHLA for the purpose of this invention. The profile of the deactivation flank 50*b* is critical. In this particular example, the resulting valve 4 and/or bridge 5 closing velocity generated by the profile of the deactivation flank 50*b* exceeds the predetermined closing velocity of the RSHLA 20. In this case, the closing body 27 would be forced into contact with the opening 28*a* and block the hydraulic fluid flow (P) from the lower chamber 28*c* to the upper chamber 28*b*. This could create higher pressure in the lower chamber 28*c* that would prevent the plunger 23 from compressing downward relative to housing 21, which in turn would prevent the valve 4 from closing, which would lead to engine malfunction or failure.

In contrast, the profile 50' for the engine brake system 30 is designed such that the deactivation flank 50*b*' is extended, lengthened, or prolonged such that deactivation of the engine brake system 30 takes longer than an unmodified or unaltered engine braking system. Or, conversely, the RSHLA 20 can be designed such that the predetermined closing velocity is greater than the engine braking system 30 deactivation velocity. As shown in profile 50', in one embodiment, the engine brake system has a longer deactivation period and lower velocity (shown by flank 50*b*') than the activation period and velocity (shown by flank 50*a*'). In one embodiment, the engine brake system has a longer deactivation period and lower velocity (shown by flank 50*b*') than the prior example deactivation profile 50*b*.

Due to this elongated deactivation flank 50*b*', once the engine brake system 30 is deactivated, the valve assembly 26 of the RSHLA 20 remains open and the RSHLA 20 compresses such that the exhaust valve 4 closes (due to the force of the spring 6). It is understood that other exhaust brake lift event profiles could be used with various profiles, which could include multiple periods of deactivation, and that more than one exhaust brake life event could be incorporated over the duration of the base circle event. The present embodiments will accommodate any conceivable exhaust brake lift event as long as the velocity(s) of the closing motion(s) is less than the predetermined closing velocity of the RSHLA 20.

In one embodiment, a method of accommodating lash in a valve train including an engine braking system 30 is disclosed. The method includes arranging a RSHLA 20 between (i) a support 10 engaging a lobe 14 defined on a camshaft 12, and (ii) at least one exhaust valve 4 and/or bridge 5. The method includes activating the engine brake system 30 to drive the at least one exhaust valve 4 and/or bridge 5 to an open position, wherein the RSHLA 20 expands to maintain contact with the support 10 and the at least one exhaust valve 4 and/or bridge 5. The method includes deactivating the engine brake system 30 such that engine brake system 30 disengages from the at least one exhaust valve 4 and/or bridge 5, and the RSHLA 20 compresses as the at least one exhaust valve 4 returns to a closed position while the RSHLA 20 maintains contact with the support 10 and the at least one exhaust valve 4 and/or bridge 5.

One of ordinary skill in the art would understand that the RSHLA 20 can engage directly with components of the exhaust valve 4 and/or bridge 5 and the support 10, or the RSHLA 20 can engage with intermediate components and have an indirect engagement with the exhaust valve 4 and/or bridge 5 and the support 10.

As described herein, the present disclosure generally describes a system and method in which a closing velocity of an engine braking system 30 is less than a critical velocity or predetermined closing velocity required to close the valve assembly 26 within the RSHLA 20. The RSHLA 20 is permitted to compress or "bleed down" to a base circle height and will not provide an opening force to the exhaust valve 4.

A rate of force removal on the exhaust valve 4 (optionally via the valve bridge 5) by the engine brake system 30 must induce a velocity of the plunger 23 relative to the housing 21 of the RSHLA 20 that is lower than critical velocity in order for the closing body 27 to remain unseated and the valve assembly 26 to remain open.

Having thus described the present invention in detail, it is to be appreciated and will be apparent to those skilled in the art that many physical changes, only a few of which are exemplified in the detailed description of the invention, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LOG OF REFERENCE NUMERALS valve train arrangement 2
exhaust valve 4
bridge 5
valve closing spring 6 support 10
cavity 11*a*
cam follower 11*b*
camshaft 12
lobe 14
RSHLA 20, 20'
outer housing 21
hydraulic fluid passage 22
leakage gap 22'
plunger 23
return spring 25*a*
valve spring 25*b*
valve assembly 26
closing body 27
opening 28*a*
upper chamber 28*b*
lower chamber 28*c*
retainer 29
engine brake system 30, 30'
profiles 50, 50'
activation flank 50*a*, 50*a'*
deactivation flank 50*b*, 50*b'*

What is claimed is:

1. A valve train arrangement comprising:
at least one exhaust valve;
a support arranged adjacent to the at least one exhaust valve and configured to engage a lobe defined on a camshaft, the support defining a cavity;
a reverse-spring hydraulic lash adjuster (RSHLA) positioned within the cavity of the support, the RSHLA configured to adjust lash between the support and the at least one exhaust valve, and the RSHLA having a predetermined closing velocity; and
an engine brake system configured to engage the at least one exhaust valve, such that:
(i) upon activation of the engine brake system, the engine brake system engages the at least one exhaust valve to open the at least one exhaust valve;
(ii) upon deactivation of the engine brake system, the engine brake system disengages the at least one exhaust valve such that the at least one exhaust valve is closed;
wherein a deactivation velocity of the engine brake system is lower than the predetermined closing velocity of the RSHLA.

2. The valve train arrangement of claim 1, wherein the RSHLA includes:
an outer housing defining at least one hydraulic fluid passage;
a plunger slidingly arranged within the outer housing;
a return spring arranged between the outer housing and the plunger;
a valve assembly having:
a closing body configured to block an opening defining a connection between an upper chamber and lower chamber of the RSHLA,
a retainer arranged between the plunger and the outer housing to hold the closing body, and
a valve spring positioned between the opening and the closing body, the valve spring biasing the closing body to an open position.

3. The valve train arrangement of claim 2, wherein the valve assembly is open and the closing body remains unseated from the opening during deactivation of the engine brake system.

4. The valve train arrangement of claim 2, wherein the predetermined closing velocity of the RSHLA is determined based on a speed of a relative displacement between the plunger and the outer housing, wherein the closing body becomes seated to the opening during the relative displacement.

5. The valve train arrangement of claim 2, wherein the predetermined closing velocity of the RSHLA is based on at least one of:
viscosity of hydraulic fluid in the RSHLA;
flow rate of hydraulic fluid in the RSHLA;
clearance between the plunger and the outer housing;
flow rate through orifices defined in the retainer;
a relative distance between the retainer, the closing body, and the opening;
a profile of an interface defined between the closing body and the opening;
stiffness of the return spring; or
stiffness of the valve spring.

6. The valve train arrangement of claim 1, wherein the RSHLA is in an extended position after activation of the engine brake system.

7. The valve train arrangement of claim 6, wherein the RSHLA moves from the extended position to a compressed position upon the engine brake system transitioning from activation to deactivation.

8. The valve train arrangement of claim 1, wherein the support is a lifter.

9. The valve train arrangement of claim 1, wherein the support is a rocker arm.

10. The valve train arrangement of claim 1, wherein the support is a finger follower.

11. The valve train arrangement of claim 1, wherein the at least one exhaust valve is supported in an exhaust valve bridge.

12. The valve train arrangement of claim 1, wherein the engine brake system includes at least one of: an actuator or a lobed shaft.

13. A method of accommodating lash in a valve train including an engine braking system, the method comprising:
arranging a reverse-spring hydraulic lash adjuster (RSHLA) between (i) a support engaging a lobe defined on a camshaft, and (ii) at least one exhaust valve;
activating an engine brake system to drive the at least one exhaust valve to an open position, wherein the RSHLA expands to maintain contact with the support and the at least one exhaust valve; and
deactivating the engine brake system such that the engine brake system disengages from the at least one exhaust valve, and the RSHLA compresses as the at least one exhaust valve returns to a closed position while the RSHLA maintains contact with the support and the at least one exhaust valve,
wherein the RSHLA has a predetermined closing velocity and a deactivation velocity of the engine brake system is lower than the predetermined closing velocity of the RSHLA.

14. The method of claim 13, wherein the RSHLA includes:
an outer housing defining at least one hydraulic fluid passage;
a plunger slidingly arranged within the outer housing;
a return spring arranged between the outer housing and the plunger;
a valve assembly having:
a closing body configured to block an opening defining a connection between an upper chamber and lower chamber of the RSHLA, a retainer arranged between the plunger and the outer housing to hold the closing body, and a valve spring positioned between the opening and the closing body, the valve spring biasing the closing body to an open position.

15. The method of claim 14, wherein the predetermined closing velocity of the RSHLA is based on at least one of:

viscosity of hydraulic fluid in the RSHLA;

flow rate of hydraulic fluid in the RSHLA;

clearance between the plunger and the outer housing;

flow rate through orifices defined in the retainer;

a relative distance between the retainer, the closing body, and the opening;

a profile of an interface defined between the closing body and the opening;

stiffness of the return spring; or stiffness of the valve spring.

* * * * *